United States Patent [19]

Reuter

[11] Patent Number: 4,848,427

[45] Date of Patent: Jul. 18, 1989

[54] METHOD AND APPARATUS FOR CHIPPING AND DISECTING OF TREE LOGS ON ALL SIDES

[75] Inventor: Alfred Reuter, Oberkirch, Fed. Rep. of Germany

[73] Assignee: Gebruder Linck Mashinenfabrik "Gatterlinck" GmbH & Co. KG, Fed. Rep. of Germany

[21] Appl. No.: 17,568

[22] Filed: Feb. 24, 1987

[30] Foreign Application Priority Data

Feb. 27, 1986 [DE] Fed. Rep. of Germany ..... 3606292
Jan. 30, 1987 [DE] Fed. Rep. of Germany ..... 3702890

[51] Int. Cl.[4] ..... B27M 1/00; B27B 1/00; B27C 1/08

[52] U.S. Cl. ..... 144/369; 144/39; 144/3 R; 144/376; 144/378

[58] Field of Search ..... 144/1 R, 3 R, 39, 41, 144/369, 370, 376, 378

[56] References Cited

U.S. PATENT DOCUMENTS

| | | | |
|---|---|---|---|
| 3,304,971 | 2/1967 | Pease | 144/378 |
| 3,457,978 | 7/1969 | Ahlstedt | 144/370 |
| 3,738,404 | 6/1973 | Walker | 144/369 |
| 3,934,630 | 1/1976 | Cockle | 144/39 |
| 4,239,069 | 12/1980 | Zimmerman | 144/376 |
| 4,324,277 | 4/1982 | Kreibaum | 144/378 |
| 4,335,767 | 6/1982 | Reuter | 144/378 |
| 4,570,687 | 2/1986 | Dietz | 144/369 |

FOREIGN PATENT DOCUMENTS

| | | | |
|---|---|---|---|
| 3514892 | 8/1986 | Fed. Rep. of Germany | 144/378 |

*Primary Examiner*—W. Donald Bray
*Attorney, Agent, or Firm*—Jones, Day, Reavis & Pogue

[57] ABSTRACT

In a method for profile chipping, the necessary chipping out of wany-edged corners laterally defining a side board (4) to be separated is carried out in such a manner that firstly in a direction perpendicular to the trunk axis saw incisions (6) are made to the full depth of the corner but that material adjacent the saw incision (6) is simultaneously chipped out by chipping blades only to a lesser depth, and in a second working step in a second direction perpendicular to the first direction (17) remaining corner material (20) is chipped out by means of chipping blades and simultaneously a second saw incision (18) is made. The side board (4) exposed in this manner is separated by a saw severance cut. This provides throughout corner faces worked by saw cut which do not have any material splits due to chipping blades.

29 Claims, 9 Drawing Sheets

Fig. 8
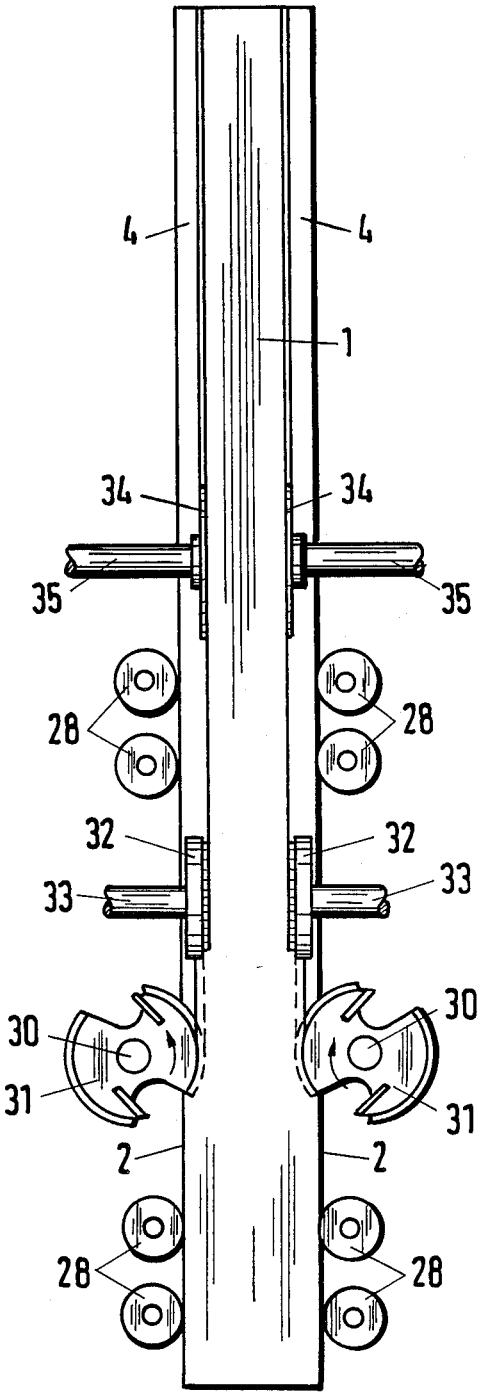
Fig. 10
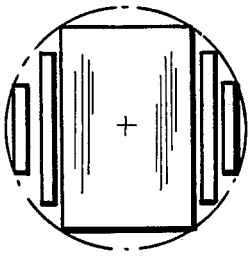
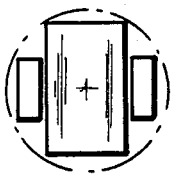
Fig. 9

METHOD AND APPARATUS FOR CHIPPING AND DISECTING OF TREE LOGS ON ALL SIDES

The invention relates to a method for the chipping and dissection of tree logs into all-round machined lumber products such as boards and squared timber. The so-called profile, chipping method is used wherein the log, having wany edge regions over at least a portion of its length, is flattened at right-angles at four sides. In the course of the machining, the corners are worked out at right-angles from the wany edge regions, whereby the corner material of each corner is worked out in a first direction perpendicularly to the log axis, and side boards bordered by two of the worked out corners are cut off by saw severance cuts in a second direction perpendicular to both the log axis and to the first direction. The invention also relates to an apparatus for use with such a method.

A method of the aforementioned type is known from U.S. Pat. No. 4,335,767. The particular matter in the method described therein resides in that the wany-edged corners are laterally worked out from the trunk to define a side board to be separated. The wany-edged corners are worked out, preferably with a combined tool having a saw and a chopping blade in such a manner that one of the corner faces is sawed to form a final surface machining and the other corner face is formed by the chopping blades such that the corner faces are perpendicular to one another. The severance cut for severing the side board, defined by two such corner sinking operations, is then made such that the severing saw grazes over the corner faces worked with the chopping blades and in the course of the severance cut works said faces with saw cut quality.

This method can be used successfully with a great number of different types of woods such that with a minimum of working expenditure, wood products having saw cut quality all around are obtained. However, certain difficulties can arise with very hard woods or at least with wood types which are very knotty and in which the knots or branches either have a substantially greater hardness than that of the remaining wood or in their environment have a fibre direction merging arcuately from the direction of the branch into the wood growth direction. Since in the known method the unsawn face of the corner sinking is worked with the peripheral face of the cutting tool carrying the chopping blades (i.e. directly with the chopping blade cutting edges) under the aforementioned unfavourable conditions, in particular in the vicinity of knots or branches, splits can form in the wood surface which have such a depth that they cannot be completely eliminated even by the subsequent grazing severance saw cut.

The invention improves the aforementioned method such that under the unfavourable conditions, machined wood surfaces are formed without the damage caused by the prior art method. It is also the object of the present invention to provide an apparatus suitable for carrying out the improved method.

The problem of the prior art is solved according to the invention in that the corner material of a corner is worked out partially from the corner in each case in two separate steps. The working out in one of the steps taking place in a first direction and in the other steps in a second direction.

Before discussing in detail the invention and the preferred embodiments based thereon, some of the terms used in the claim wording will be explained in detail or defined:

Regarding the preamble of claim 1 and the order of the method steps set forth therein, the four-sided flattening of the tree trunk is mentioned first; however, this does not necessarily define the time sequence of the individual steps. In practice it is usual to first flatten two opposite sides of the tree trunk using first tools and directly thereafter to flatten the two remaining opposite sides of the trunk using second tools. The flattening operation can be accomplished by arranging the second tools perpendicularly to the first tools or by turning the trunk through 90° after using the first tools. Moreover it is possible to use only one set of tools and pass the trunk through the set a second time after rotating the trunk 90°. It is also possible to first flatten two opposite sides of the trunk and then cut out the wany-edged corners bordering these sides and even cut off the exposed side boards. After these operations the two remaining trunk sides can be flattened and further machining steps carried out.

In describing the method according to the invention, reference is made to a first and second direction, each being perpendicular to the trunk axis in which the corner material of the trunk is worked or carved out. This is intended to designate the direction in which, with respect to a certain point of the trunk length, the tool increasingly penetrates into the wood material. The expert knows that by the advancing movement of the trunk in its longitudinal direction with respect to the stationary tools, penetration of the tools into the wood material also takes place with a component pointing in the longitudinal direction of the trunk. This applies equally to the carving out in the first direction and in the second direction.

When, with reference to the working out or carving out of a corner in this regard, the cutting out with chip removal of further corner material and the remaining corner material is mentioned, this does not mean a step-shaped cut-out corner region as is for example the subject of U.S. Pat. No. 4,327,789. Rather, a single corner which defines one side board or possibly several side boards of equal width is accomplished. The term "remaining corner material" relates to the material to be removed for the complete working out of such a corner. Thus, in a corner region of the trunk a wany edge may remain which is removed by cutting or milling out a further corner. The respective method according to U.S. Pat. No. 4,327,789 is applicable in combination with the method claimed here.

Corresponding to the possible modification of the order of the side flattening, the corner millings also need not be carried out simultaneously but can for example be carried out in successive pairs.

When the claim wording sets forth that a corner incision is to be made "substantially" up to the corner point of the corner, this limitation is intended to express that the corner point is not mathematically exactly defined but, for example, on subsequent severing of a side board can be displaced by one saw cut width.

The introduction of at least one tool head of the first type in the preamble of claim 23 is intended to include: first; the construction claimed in a subsidiary claim according to which a machining unit includes the tool heads generally in pairs for simultaneously working the cant from two opposite sides; and second, a construction in which a generally combined tool head with chopping blades and saw blade is divided into two consecutive tool heads, one of which comprises only the chopping blades and the other of which only the saw blade for a saw incision. For practical design reasons however such a construction is not usual. The definition of at least one tool head of a second kind is to be understood accordingly.

The concept of the provision of at least one severing saw is intended to include the possibility of the presence of a single band saw for severing a side board. If the severing of the side board is by means of circular saws, in general, two circular saws, offset in the feed direction of the trunk with respect to each other, are provided and each enter the trunk from opposite sides. More than one severing saw can also be provided where adjacent the severing saws for separating the side boards, further severing saws are present for cutting up the main products.

The method according to the invention avoids the disadvantages mentioned in conjunction with the method of U.S. Pat. No. 4,335,767 in that the working out of the corner material, advantageous in itself, in the direction perpendicular to the saw severance cut is carried out only partially and the corner material adjoining the saw severance cut is worked or carved out substantially in the second direction parallel to the saw severance cut.

Within the scope of the invention it is fundamentally possible to work out corner material in a first step in the first direction and remaining corner material in the second direction in a second step or vice versa. Both these method variants have their advantages and disadvantages. The first variant is based on the known method in which in the first direction perpendicular to the saw severance cut at least one fine working of the face perpendicular to the saw severance cut is carried out. In a preferred embodiment, depending on the trunk diameter, corner material is chimed out in the first direction but only up to a depth which is less than the depth of the corner so that corner material remains adjoining the saw severance cut which is then worked out in a second step in a direction parallel to the direction of the saw severance cut. The quality-endangering corner face due in the known method to the peripheral cutting of the chopping blades is engaged in this manner only by the end side of the blade head, thus avoiding disadvantageous splitting. If the tool head used for this purpose with chopping or chipping blades (the two expressions being used interchangeably) produced the corner face adjoining said end side of a quality sufficient to obtain a final surface in saw quality by the sweeping working of the severance saw, it would not be necessary to work this face by an additional parallel saw incision when cutting out the corner material adjoining the saw severance cut. However since the face worked by the end side of a chopping blade head frequently does not have the desired quality, in a preferred embodiment of the method described herein, in the chipping out of the corner material adjacent the saw severance cut as well a saw incision is also made in the second direction. It is particularly advantageous when the saw incision trails the feed of the chopping blades that the material to be removed by the chopping blades is still joined to the trunk. This trailing of the saw cut is achieved preferably, using a combined tool head which carries the chopping blades and the saw blade elements where the orbital diameter of the saw blades is somewhat less than that of the chopping blades.

If the orbital diameter of the saw blade elements were somewhat greater than that of the chopping blades in the case where a saw incision has already been made in the first direction a wood strip bordered at its rear side by the first saw incision would be separated by a depth of the second saw incision up to the corner point of the corner from the trunk before the chopping blades of the tool head could cut it up for the second step. The certain remaining shoulder which results from the second saw incision not being made up to the corner point of the corner can easily be removed by the sweeping severance saw.

The partial working out of the corner material in the first direction can be effected by a first saw incision or by partial chipping out over a full corner width or by both steps simultaneously or consecutively, the first saw incision being made before the partial chipping out.

In each case the objective of these steps is for the corner face extending parallel to the first working direction to already have a high working quality.

Even if in the first working out stage a combined tool with chopping blades and saw blade is used in which the orbital radius of the saw blade is greater by about a chopping chip width than that of the chopping blades, it may happen due to the tapering, i.e. the conicity, of the trunk that the wany-edged corner at the crown of the trunk becomes so small that the corner depth is below the width of a utilizable chopping chip so that although a saw incision is still made in the first direction the chopping blades no longer have any grip. If thin trunks are continuously worked it may be that the chopping blades can be omitted in the first machining step. Such deviations are within the scope of protection of the present invention.

Likewise, for the first working step in the first direction tools are conceivable which for fine working of the corner face lying parallel to the first direction do not have a saw blade but are possibly themselves suitable for carrying out fine working of said face due to their specific blade arrangement. The first machining step is thus necessarily linked to the presence of a saw blade element. According to the invention such a tool head could also be used for the second working step.

According to the second basic variant of the method according to the invention during the first step the corner material is worked out in the second direction parallel to the saw severance cut and the remaining corner material which adjoins the face perpendicular to the saw severance cut is worked out in a second step in the first direction parallel to said corner face.

This converse working sequence can have various advantages. Thus, the tool head for the first working step in the second direction need only correspond to the thickness of the side board to be separated and can be restricted to said thickness. Since the side products generally have a relatively small thickness only a narrow tool head is required here which moreover also lies in the width range of a commercially utilizable chopping chip so that no further division of the chopping chips into chips suitable for further processing is necessary.

In so far as the second direction is vertically directed, which is convenient for practical reasons, it may be advantageous to carry out the main chip removal from the corners in the second direction because the trunk is generally supported in this direction by a table support by which the occurence of oscillations of the trunk in the working is reduced. A working with horizontally directed forces can easily lead to vibrations of the trunk in the horizontal direction and this can have disadvantageous effects on the following saw blades of the severance saws.

When using combined tools it is also advantageous in the second method variant described here that in the tool for the first working step the tooth projection of the saw blade elements with respect to the chopping blades can be kept smaller than in the first variant. This contributes to improved lateral stability of the teeth. In the second method variant it should even be ensured that the first saw incision in the first direction is not made too deep so that the remaining corner material to be chipped out in the second step at the end of the first working step is still sufficiently joined to the trunk. The cutting or chipping out in the first working step should be made only to a depth such that the remaining corner material after taking account of the second saw incision of the second working step still has the width of a utilizable chopping chip. Substantially over half this width the remaining corner material, after execution of the first saw incision in the plane of the subsequent severance step, should remain joined to the material of the trunk.

On the other hand, it is also, of course, conceivable for the second method variant to use tools which leave directly a finely worked side face so that the use of a saw blade in combination with chopping blades is superfluous. The essential point according to the invention is that the corner faces do not undergo any direct working by means of the peripheral cutting edges of the chopping blades.

An apparatus suitable for the method according to the invention is characterized in that in the direction of the feed path either before or after the at least one tool head of the first type and before the possibly at least one severance saw at least one tool head of a second type is provided which is driven rotatably about a second axial direction extending perpendicularly to the trunk axis and to the first axial direction. The tool head of the second type comprises chopping blades disposed at its periphery substantially parallel to the axis of the tool elements.

A preferred embodiment of the apparatus resides in that in each case a tool head of the first type and a tool head of the second type, which consecutively execute the two working steps for working out a corner, are disposed on a common adjustable carriage. Since the two working heads for the working out of a corner remain in fixed mutual position with respect to each other they can be set up fixed in their mutual position. For changing the position of the corner to be worked out it is then only necessary to adjust the common carriage.

Hereinafter the invention will be explained in detail will reference to the attached drawings, wherein:

FIG. 8 shows a schematic plan view of a part of the apparatus for carrying out the method described in accordance with the first variant thereof;

FIGS. 9 and 10 show two squared timber profile cross-sections which can be made with the method described;

Figure 1:
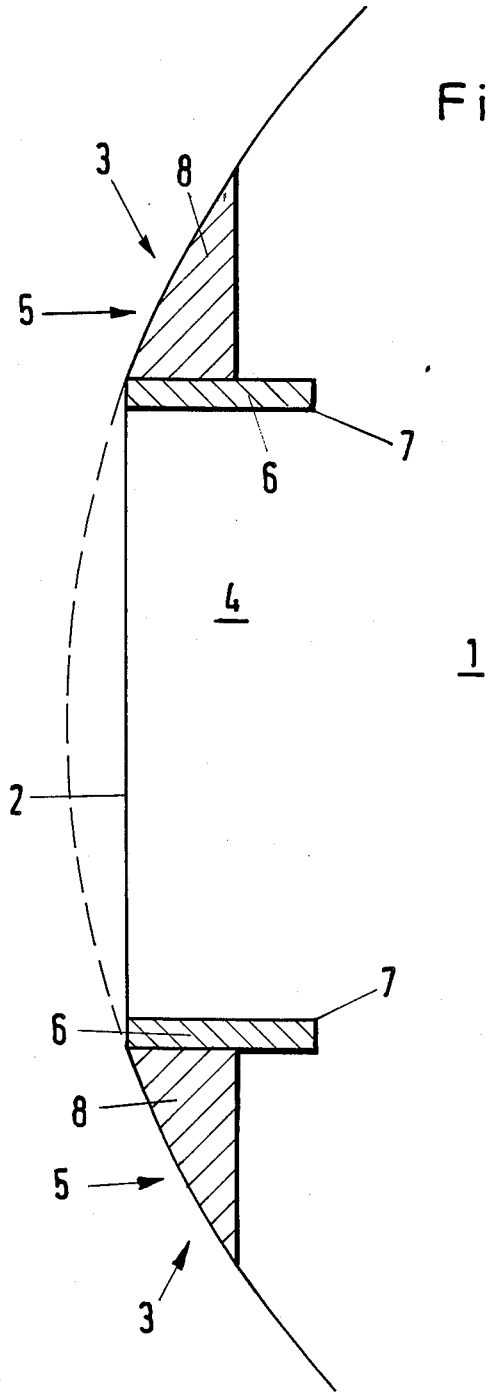
FIGS. 1–3 show the partial cross-section of a tree trunk in schematic illustration on which stopwise the working out of two wany-edged corners is indicated according to a first method variant up to severance of the side board exposed by the corners.

FIG. 1 shows, schematically, the partial cross-section of a tree trunk 1 comprising a flattened outer side 2 at the two sides of which the milling out of wany-edged corner regions 3 is to be carried out. The regions are to define laterally a side board 4 having the flattened face 2 as an outer side. In a first working step for working out the wany-edged corner regions 3, the wood portion indicated hatched in FIG. 1 is removed by working out in the direction of the arrow 5. From this direction, for each corner, a first saw incision 6 is introduced which extends up to the full depth of the intended corner cutting out, i.e. up to the corner point 7 of the corner to be worked out. The depth of the first saw incision 6 simultaneously defines the thickness of the side board 4 to be subsequently separated. Simultaneously or directly after the introduction of the first saw incision further wood material 8 is also chipped out from the direction of the arrow 5 from the corner region 3 in the form of chopping chips. The depth of the chipping out defined by the hatched region 8 remains however less than the depth of the first saw incision 6. The difference in depth should be such that the remaining material strip can still be removed without any problems with chopping blades and worked to commercial pulp or particle board chips.

Figure 4:
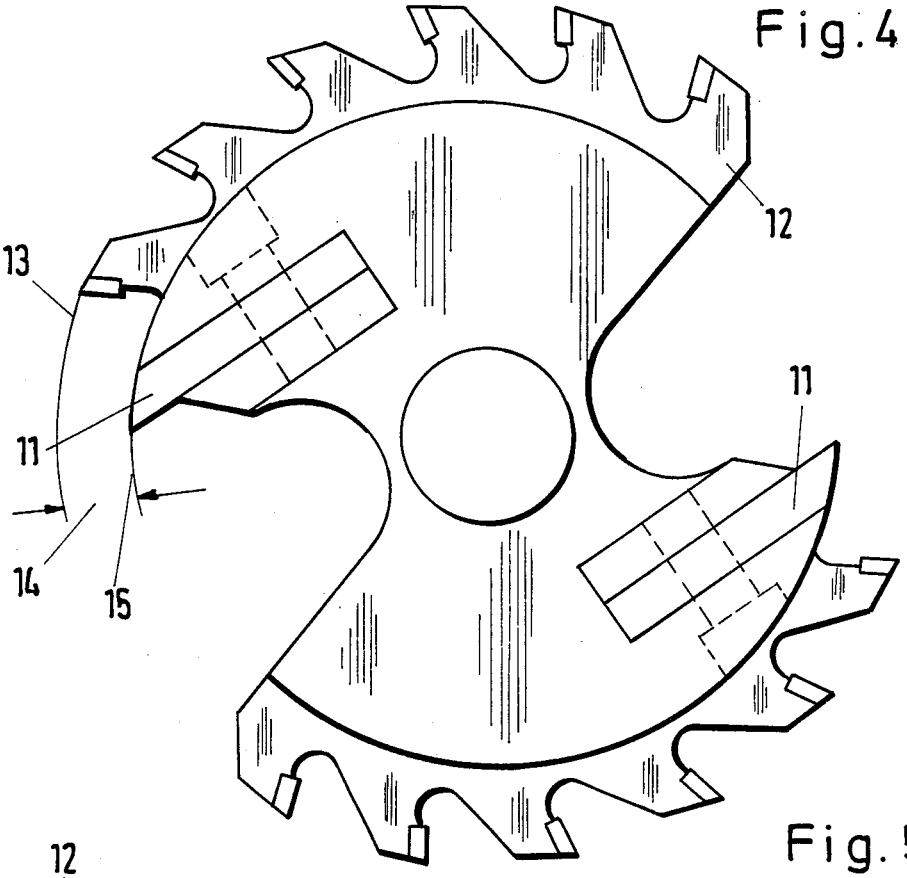
FIGS. 4 and 5 show in schematic plan view and side view a tool head of a first type for working out the material shown hatched in FIG. 1.
Figure 5:
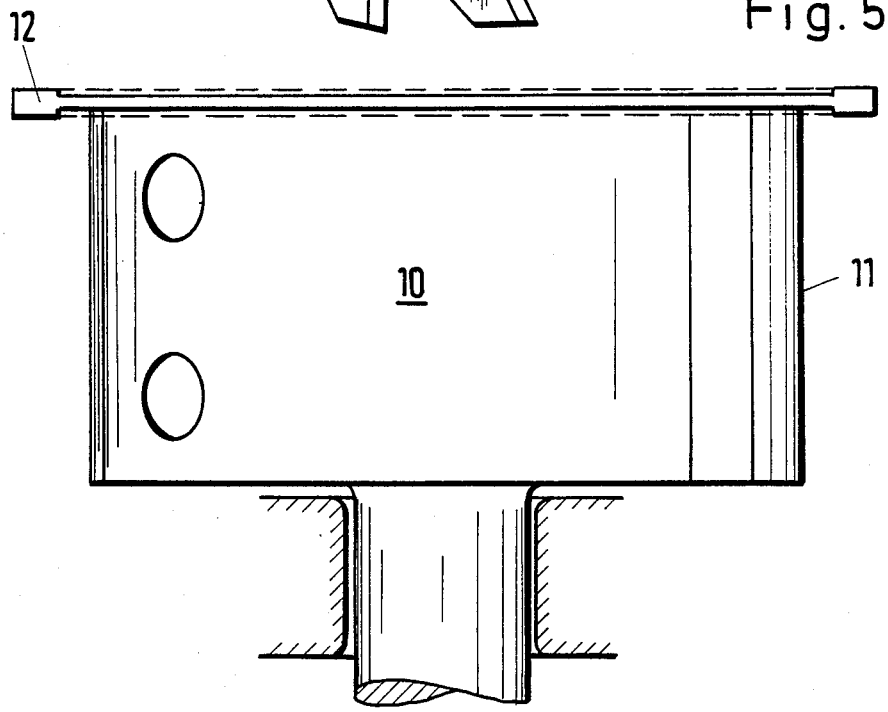

The working out of the material shown hatched in FIG. 1 is preferably done with a combined tool head which with respect to the tree cross-section position according to FIG. 1 rotates about a perpendicular axis. Such a tool head is shown schematically in FIGS. 4 and 5.

The tool head consists of a substantially cylindrical chopping blade carrier 10 which is carried by a drive shaft 9 and comprises at its periphery chopping blades 11 whose cutting edges extend substantially in the direction of a cylinder generatrix. At the free end side of the chopping blade carrier 10 a saw blade 12 consisting of two segments is disposed. The orbit of the blade 12 has a radius difference 14 with respect to the orbit 15 of the chopping blades 11 so that the orbit radius of the saw blade 12 is greater than that of the chopping blades 11. The radius difference 14 corresponds to the depth difference between the first saw incision 6 and the chipping out depth of the further material 8 in FIG. 1. The radius difference 14 may be between about 10 and 25 mm.

Figure 2:
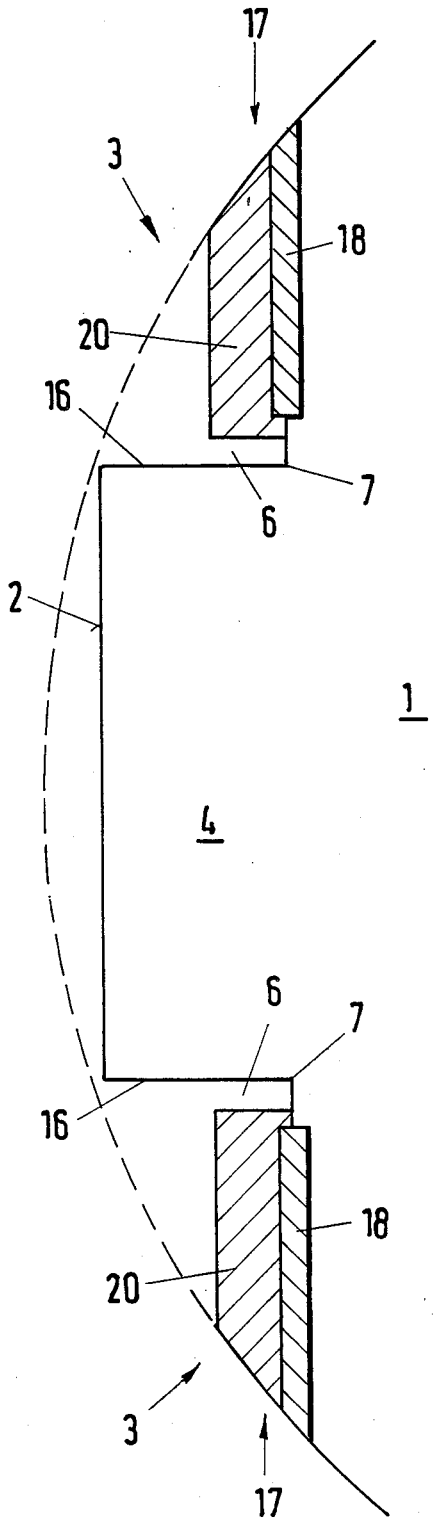

The further step for working out the corner regions 3 is shown in FIG. 2. According to the illustration in this FIGURE, two corner faces 16 are already present which have been worked by the first saw incisions 6 in saw cut quality and which simultaneously form the long edge faces of the side board 4 to be subsequently separated. The working out of the remaining corner material is now from the direction of the arrows 17 by means of a second saw incision 18 which substantially works the other corner face 19 (FIG. 3) in saw cut quality, and a chipping out 20. Altogether, the material shown hatched in FIG. 2 is removed by the second working step. When working out this material in the direction of the arrows 17 the chopping blade tool leads the saw somewhat so that the material to be removed thereby is still joined somewhat to the trunk 1. If this were not the case, at least towards the end of this working step the saw incision 18 would separate from the cant 1 a material strip which could no longer be gripped by the chopping blade for breaking down into chopped chips. Whereas in the practical execution the chopping blade is driven into the space of the first saw incision 6 to remove the material strip 20 as completely as possible, the second saw incision 18 is not made right up to the first saw incision 6 and consequently the last remaining part of the material strip 20 is still joined somewhat to the trunk 1 when engaged by the chopping blades.

Figure 3:
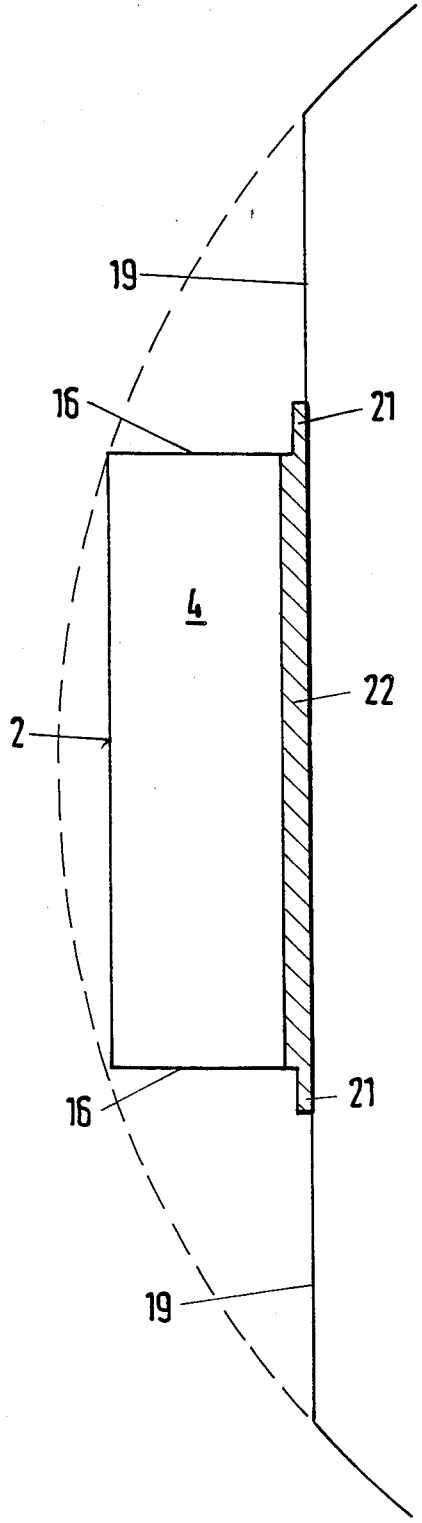

As apparent from FIG. 3, as a result of the milled out corner a slight shoulder 21 remains which can be removed completely within the course of the severance cut for the side board 4 by a grazing saw cut. By means of the severance cut the material shown hatched in FIG. 3 is then removed, thereby completely separating the side board 4 from the trunk 1.

Figure 6:
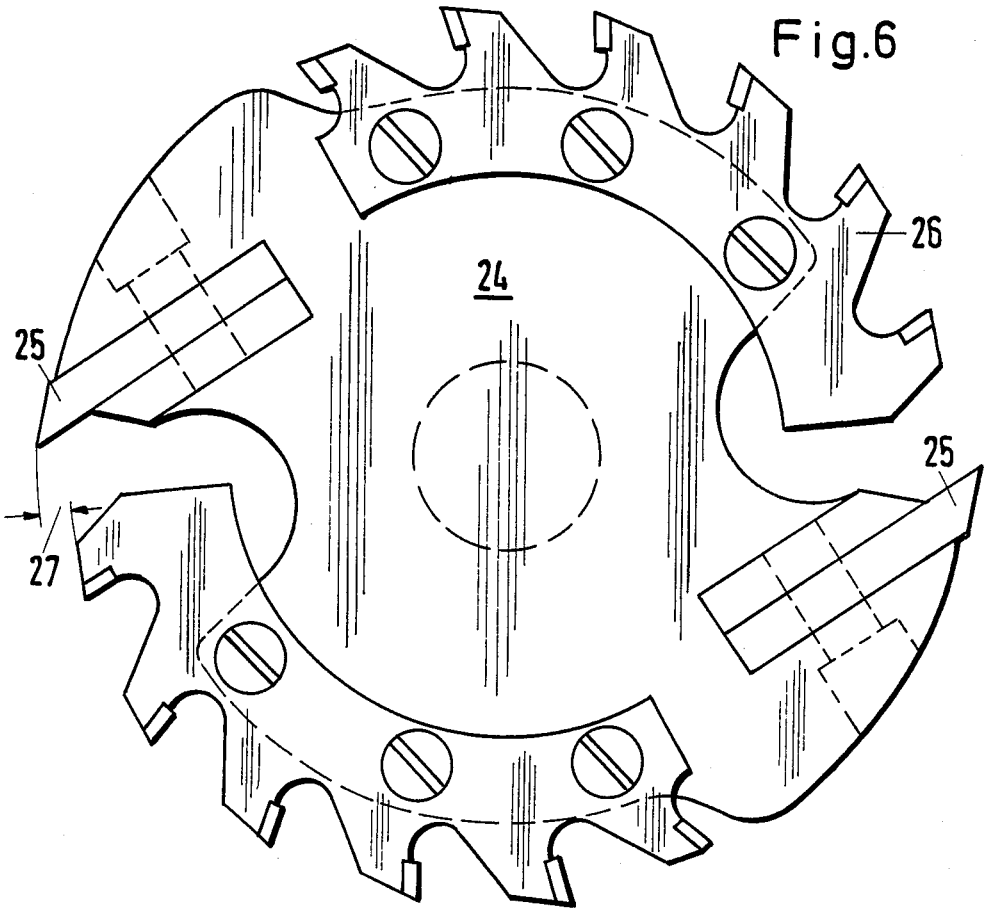
FIGS. 6 and 7 show in schematic plan view and side view a working head of a second type for working out the material shown hatched in FIG. 2.
Figure 7:
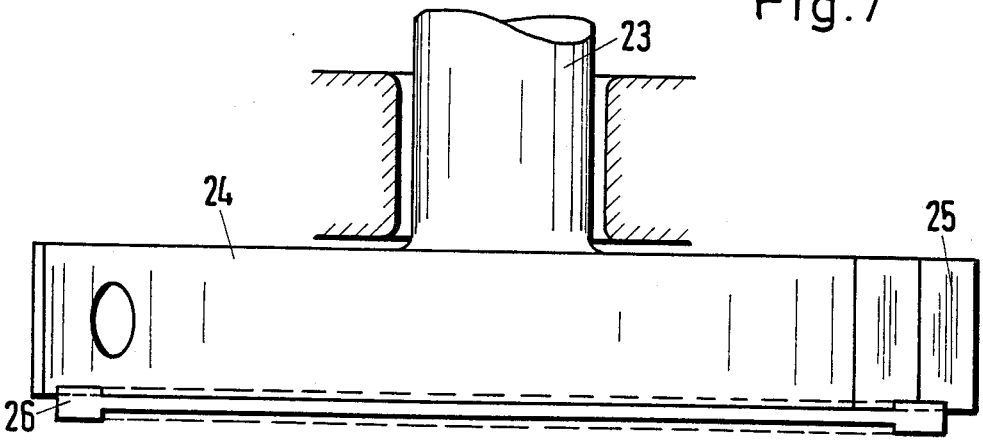

A tool head for working out the remaining corner material according to the method step of FIG. 2 is shown in FIGS. 6 and 7. The tool head of the second stage comprises a chopping blade carrier 24 which is in flying mounting on the drive-shaft 23 and at the periphery of which two chopping blades 25 are disposed. At its free end side this tool head also carries a saw blade 26. In contrast to the tool head of the first stage, the saw blade 26 has a smaller orbital diameter than the chopping blades 25 as indicated by the radius difference 27 in the drawing. Said radius difference 27 is conveniently somewhat greater than the thickness of the saw blade 12 of the tool head of the first stage. In practice, it will probably be sufficient for the radius difference 27 to correspond substantially to twice the thickness of the saw incision 6.

In the practical implementation of the method described the working steps explained with reference to FIGS. 1 to 3 are advantageously carried out laterally inverted and simultaneously on opposite sides of the tree trunk 1. Such a simultaneous execution is shown in FIG. 8 which represents schematically a fragment of an apparatus for carrying out the method described in its first variant. A trunk 1 is advanced by means of feed rollers 28 on a conveyor path not otherwise shown in the direction of the arrow 29. The trunk 1 is already flattened at its outer faces 2. Two tool heads of the first type 31 rotating about vertical axes and corresponding in their construction to the tool heads according to FIGS. 4 and 5 first remove at both sides of the trunk 1 the material shown hatched in FIG. 1. Concealed by the two tool heads 31 shown in FIG. 8 in plan view and disposed therebelow are two further tool heads of similar type arranged laterally inverted to work the lower corners of the trunk 1. After the tool heads of the first type 31, tool heads of the second type 32 then engage the trunk 1. The heads 32 are rotatably driven about horizontal shafts 33. The tool heads of the second type 32 correspond to the tool head illustrated in FIGS. 6 and 7. With them the material shown hatched in FIG. 2 is worked out. Here as well, two further tool heads are provided which are concealed in the plan view by the two illustrated heads 32. Finally, the side boards 4 are separated from the trunk 1 by two severance saws 34, also driven rotatably about horizontal shafts 35. In this operation the material shown hatched in FIG. 3 is removed. At the end of the illustrated working sequence timber and two side boards are obtained as shown in cross-section in FIG. 9. FIG. 10 shows a trunk division in cross-section in which the working sequence illustrated in FIG. 8 has been carried out twice in succession at stepped off-set corners.

Figure 11:
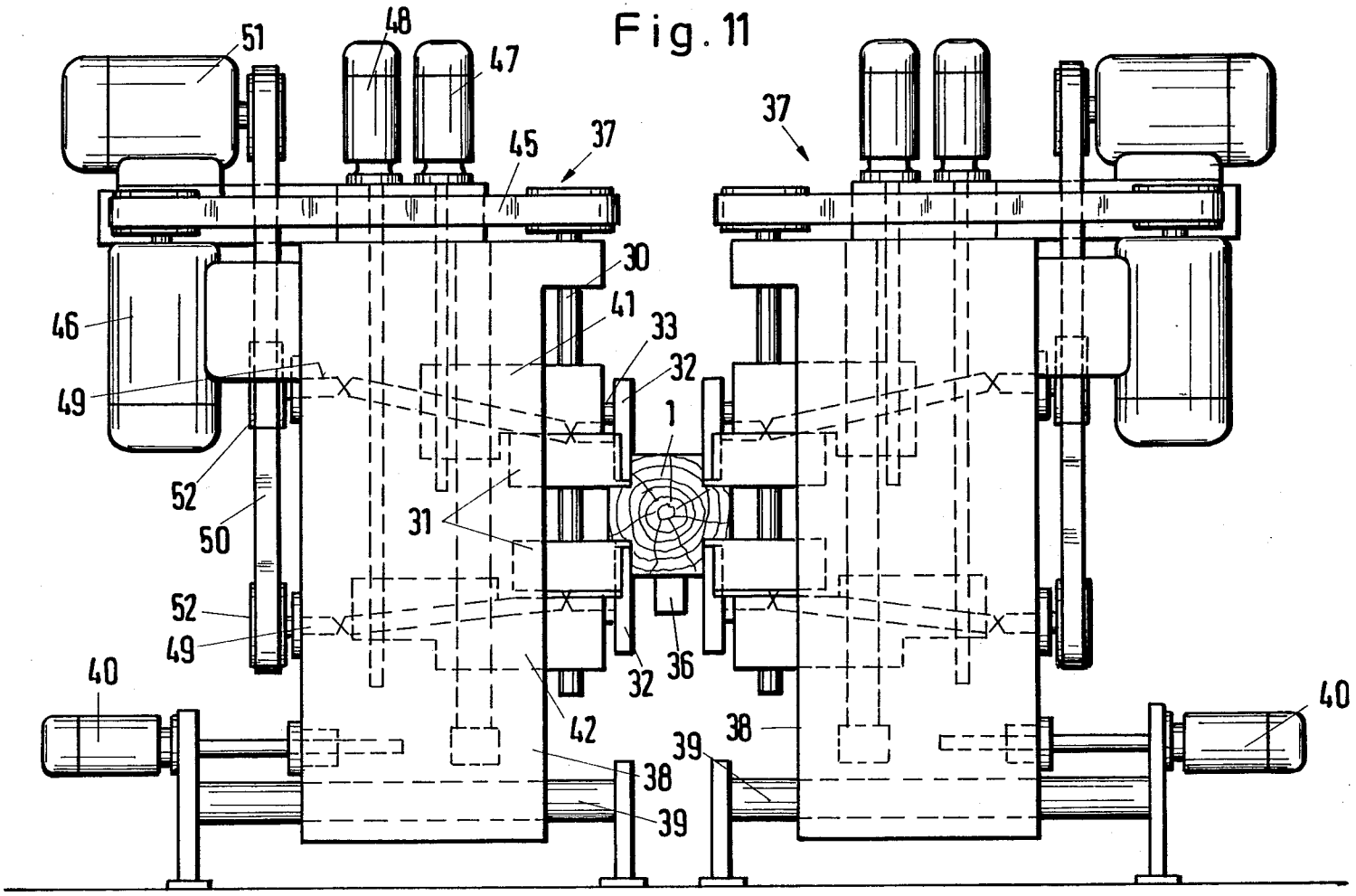
FIG. 11 is an end view of an apparatus suitable for carrying out the essential steps of the method described in its first variant.
Figure 12:
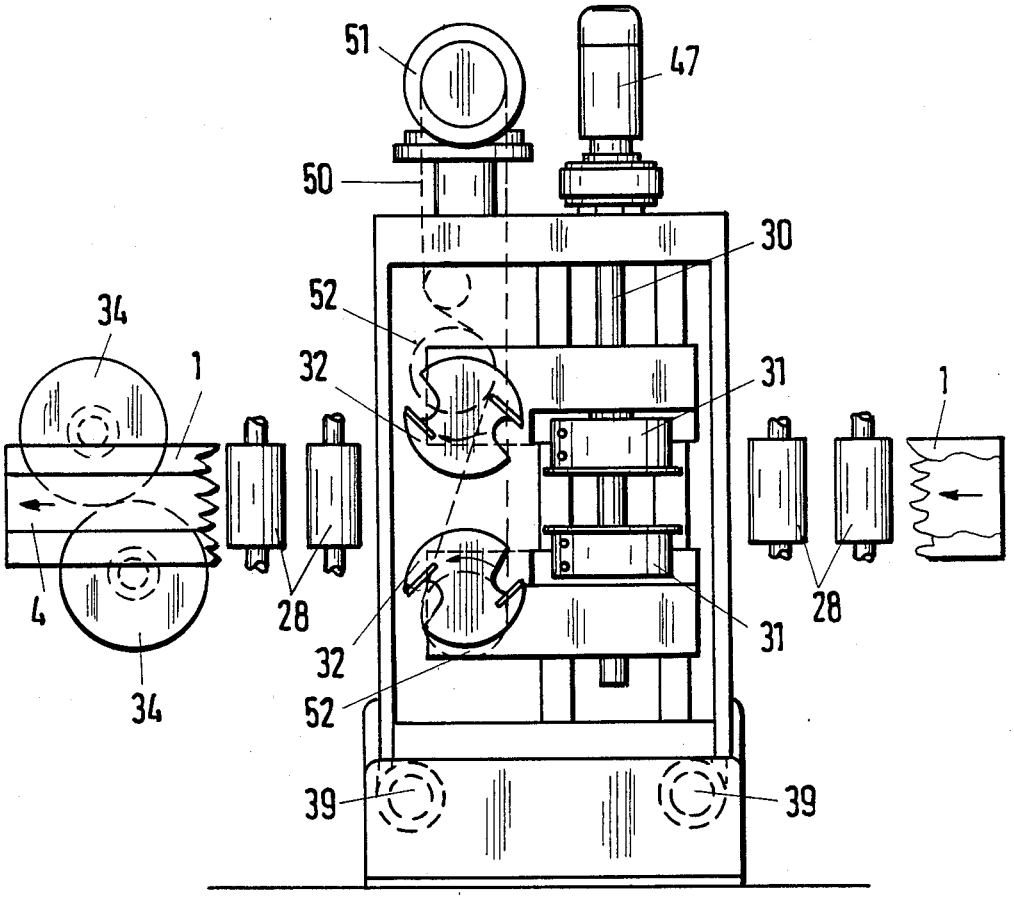
FIG. 12 is a lateral view of the apparatus according to FIG. 11 in which in addition the severance saw following the apparatus is indicated.

An apparatus which can be used for carrying out the method described is shown in detail in FIGS. 11 and 12. The apparatus includes the tool heads of the first and second types. The severance saws, as indicated in FIG. 12, do not form a direct constructional unit with the apparatus including the tool heads of the first and second type but are arranged in a separate frame which is not illustrated.

In accordance with FIG. 11, on either side of a conveying path 36 carrying the trunk 1 are two laterally inverted working units 37. The advancing of the trunk 1 on the conveying path 36 is by the feed rollers 28 indicated in FIG. 12.

Referring to FIG. 11, each working unit 37 is mounted by means of a frame 38 on a slide track 39 on which it can be moved towards and away from the conveying path 36 by means of positioning drive 40. Two carriages 41 and 42 are guided adjustably in vertical direction and carry a tool head of the first type 31 and a tool head of the second type 32. The two tool heads of the first type 31 are arranged concentrically with respect to each other and are drive by a common vertical shaft 30. For the vertical adjustability of the carriages 41 and 42 and with them the tool heads 31 the drive-shaft 30 is made as profile plug-type shaft on which the tool heads 31 are displaceable while retaining their form-locking engagement with the shaft. The drive of the vertical shaft 30 is via a belt drive 45 from a drive motor 46. The carriages 41 and 42 each have for their separate vertical adjustment their own positioning drive 47 and 48 respectively. To permit vertical adjustment of the carriages 41 and 42 carrying them, the tool heads of the second type 32 drive rotatably about horizontal shafts 33 are driven by means of double joint plug-type shafts 49 which are rotated via a common belt drive 50 from a drive motor 51. The arrangement of the belt drive 50 is better shown in FIG. 12. The belt drive is constructed such that it passes over in opposite direction the drive pulleys 52 for the tool heads 32 to rotate them in opposite directions.

Since in each case a tool head 31 and an associated tool head 32 jointly perform an overall corner milling, remain for this purpose in a fixed position with respect to each other. Thus, they may be disposed on a common carriage 41 or 42 respectively. Of course, a certain adjustment facility should be provided for the penetration depth of the one tool head with respect to the other on the carriages carrying them. The position of a corner to be cut or milled out can be defined solely by vertical adjustment of the carriage 41 and 42 and displacement of the frame 38 of a working unit 37 on the slide track 39 by means of the positioning drive 40.

Figure 13:
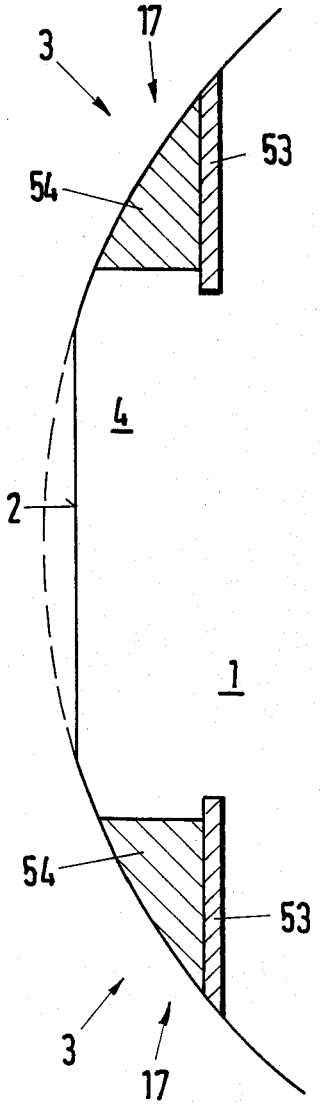
FIGS. 13 and 14 show the partial cross-section of a tree trunk in schematic illustration on which stepwise the working out of two wany-edged corners according to a second method variant is indicated.
Figure 14:
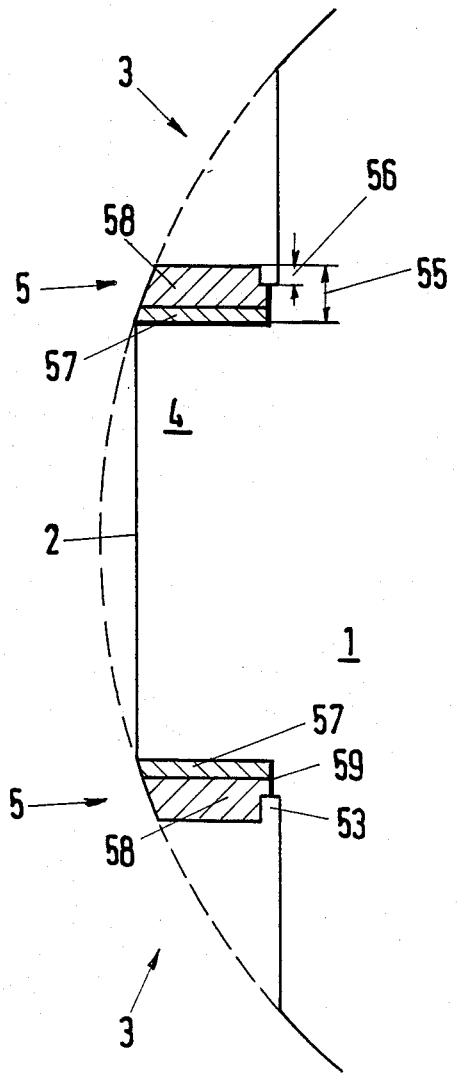

FIGS. 13 and 14 show schematically the partial cross-section of a trunk 1 with an already flattened side face 2 similar to FIGS. 1–3. In accordance with a second main method variant wany-edged corners 3 are to be worked out in order finally to be able to separate a side board 4 defined by the worked out corners. According to this second method variant as indicated in FIG. 13, in a first working step the corner material shown hatched therein is worked out in the second direction indicated by the arrows 17 and extending parallel to the direction of the saw severance cut to be subsequently made. From this direction, for each corner a first saw incision 53 is made. Simultaneously with or immediately after the introduction of this first saw incision 53 further wood material 54 is also chipped out from the direction of the arrow 17 from the corner region 3 in the form of chopped chips. This cutting out is however only up to a depth which is less by a remaining extent 55 (see FIG. 14) than the intended depth of the corner. This remaining extent 55 corresponds at least to the width of a utilizable chopped chip plus the width of a saw cut. The first saw incision 53 is made somewhat deeper than the depth with which the wood material 54 is to be cut out; the greater depth corresponds to a lead 56 (see FIG. 14) which amounts to about half the remaining extent 55 minus one saw cut width. Then, as illustrated in FIG. 14, in a second working step in the direction denoted by the arrows 5 the remaining corner material is worked out. This is done by introducing a second saw incision 57 and chipping nut the remaining material 58. To avoid any disadvantages on the face to be worked by the subsequent saw severance cut when separating the side board 4, the working out of the remaining corner material in the second direction 5 is preferably carried out only up to a depth which is less by one saw cut width than the intended depth of the corner so that the severance saw grazes the slight wood remainder 59 left behind and removes the latter.

As apparent from FIG. 13, in this method variant the tool for the first working step from the second direction 17 need not be appreciably wider than the usually occurring thicknesses of the side board 4. Moreover, when the second direction 17 extends vertically as illustrated in the FIGURES and also expedient in the practical implementation, for the removal of the major part of the material of the corner stabler working conditions are obtained because the trunk to be worked is supported in the vertical direction whereas tools penetrating in the horizontal direction can easily lead to transverse vibrations of the trunk. If for the second working step from the first direction 5 only remaining material is left in a chopping chip width the tool for this working step need only have the width necessary for this purpose.

It is obvious to the expert that if combined tools with chopping blades and saw blade elements are used as illustrated in conjunction with the first method variant in FIGS. 4–7 the orbital diameters of the individual tool elements must be made such that they correspond to the differences described in conjunction with FIGS. 13 and 14 in the penetration depth of the tools. For the second working step according to FIG. 14 a tool can be used in which the orbital diameters of the saw blade segments and chopping blades are identical.

For the execution of the second variant of the method it is likewise obvious that the sequence scheme as illustrated in FIG. 8 for the first method variant must be modified so that the working heads with the horizontal shafts, seen in the feed direction of the wood, are provided first and the working heads with the vertical shafts follow these with the horizontal shafts. This applies accordingly for the apparatus arrangement as illustrated in FIGS. 11 and 12. Basically, the same apparatus can be used, it merely being necessary for the trunk to pass through the apparatus in the opposite direction, ensuring of course the proper direction of rotation of the tool heads. The description of FIGS. 11 and 12 can therefore be correspondingly applied to a machine for carrying out the second method variant.

I claim:

1. A method for the profile chipping dissection of tree logs into all-round machined lumber products such as boards and squared timber comprising the steps of:

(a) flattening at least one outer side of a log such that two wany-edged corner regions are defined;

(b) working out the wany-edged corner regions in a first direction;

(c) working out each of the wany-edged corner regions in a second direction perpendicular to said first direction to define a side board bordered by the two worked out wany-edged corner regions; and (d) cutting off the side board by a saw severance cut.

2. A method according to claim 1, wherein a portion of each of the wany-edged corner regions is worked out in the first direction and substantially the remaining portion of each of the wany-edged corner portions is worked out in the second direction.

3. A method according to claim 2, wherein the working out of the corner material in the first direction includes the step of making a first saw incision substantially up to the intended depth of the corner of the board to create a corner face perpendicular to the saw severance cut of saw cut quality.

4. Method according to claim 1 or 2, wherein the working out of the corner material in the first direction includes the step of chipping out the corner material in the first direction up to a depth which is less than the intended depth of the corner by at least one saw cut width.

5. Method according to claim 4, wherein the chipping out of the corner material in the first direction is effected up to a distance of 10–25 mm from the corner point of the corner.

6. A method according to claim 4, wherein the saw incision in the first direction is effected prior to or simultaneously with the chipping out of the corner material in the first direction.

7. Method according to claims 1, 2 or 3, wherein the working out of the corner material in the second direction includes the step of chipping out the corner material.

8. Method according to claim 7, wherein the working out of the corner material in the second direction includes the step of making a second incision in the second direction for machining the corner face parallel to the saw severance cut.

9. Method according to claim 8, wherein the second saw incision lags behind the chipping out in the second direction.

10. Method according to claim 8, wherein the second saw incision is made to a depth less than the depth of the chipping out of the corner material in the second direction.

11. Method according to claim 8, wherein the second saw incision is made substantially in the plane of the saw severance cut.

12. Method according to claim 1, wherein the corner material is substantially chipped out in the second direction up to a depth less than the intended depth of the corner by a remaining extent where the remaining extent is equal to at least the minimum width of the commercial chips which can be chipped out in the first direction plus a saw cut width.

13. Method according to claim 12, wherein substantially simultaneously with the chipping out of the corner material in the second direction, a first saw incision is made in the second direction for machining a corner face parallel to the second direction.

14. Method according to claim 13, wherein the depth of the first saw incision is less than the intended depth of the corner.

15. Method according to claim 13, wherein the depth of the first saw incision is greater by a lead distance than the depth to which the corner material is chipped out in the second direction.

16. Method according to claim 15, wherein the lead distance is substantially half the remaining extent reduced by one saw cut.

17. Method according to claim 12, wherein a second saw incision is made in the first direction for working the corner face and the remaining corner material is chipped out up to a depth which is smaller by less than one saw cut width than the intended depth of the corner.

18. Method according to claim 13, wherein a combined tool having chipping blades and saw blade portions located concentrically on an axis is used to make the first saw incision and for chipping out the corner material in the second direction, the saw blade portions having a greater orbital diameter than the chipping blades.

19. Method according to claim 17, wherein a combined tool with chipping blades and saw blade portions located concentrically on an axis is used to make the second saw incision and for chipping out the corner material in the first direction, the saw blade portions having the same orbital diameter as the chipping blades.

20. An apparatus for chipping dissection of tree logs into all-round machined lumber products, such as boards and squared timber, comprising:

means for feeding the log to be worked along a feed path; and working units arranged on either side of a feed path being substantially laterally inverted to one another, said working units comprising at least one tool head of a first type, means for rotatably driving the tool head of the first type about a first axis perpendicular to the longitudinal axis of the log, said tool having axis-parallel too elements disposed at its periphery, and at least one severance saw disposed along the feed path downstream of the tool head of the first type and having a cutting plane extending parallel to said first axis, and at least one tool head of a second type provided along the feed path upstream of said at least one severance saw, means for rotatably driving said at least one tool head of a second type about a second axis perpendicular to the longitudinal axis of the log and to the first axis, said tool head of a second type comprising substantially axis-parallel tool elements including chipping blades at the periphery of said tool head of a second type.

21. An apparatus according to claim 20, wherein said working units are adjustable in their lateral spacing from the feed path.

22. An apparatus according to claim 20, wherein said at least one tool head of a second type is disposed along the feed path upstream of said at least one tool head of a first type.

23. An apparatus according to claim 20, wherein said at least one tool head of a second type is disposed along the feed path downstream of said at least one tool head of a first type.

24. An apparatus according to claim 20, wherein the second axis extends horizontally.

25. Apparatus according to claims 20 or 23, wherein tool heads of the first and second type are provided on each of the working units in pairs where the tool heads of each pair are adjustably spaced.

26. An apparatus according to claim 20 or 23, wherein the tool heads of the first and second type are disposed jointly on an adjustable carriage.

27. An apparatus according to claim 23, wherein the tool heads of the second type are combined tool heads which also include saw blade elements which are arranged on the tool head side directed toward the log to be worked.

28. An apparatus according to claim 27, wherein the orbit of the saw blade elements is smaller than that of the chipping blades.

29. An apparatus according to claim 28, wherein the chipping blades and saw blade elements have the same orbital diameter.

* * * * *